US005138849A

United States Patent [19]

Stoll et al.

[11] Patent Number: 5,138,849

[45] Date of Patent: Aug. 18, 1992

[54] FLAT KNITTING MACHINE

[75] Inventors: Thomas Stoll, Reutlingen; Wolfgang Rempp, Sonnenbühl; Fritz Walter, Kusterdingen; Eugen Staiger, Trochtelfingen; Hans Trissler, Reutlingen, all of Fed. Rep. of Germany

[73] Assignee: H. Stoll GmbH & Co., Reutlingen, Fed. Rep. of Germany

[21] Appl. No.: 604,239

[22] Filed: Oct. 29, 1990

[30] Foreign Application Priority Data

Oct. 27, 1989 [DE] Fed. Rep. of Germany ..... 3935763

[51] Int. Cl.[5] ..... D04B 15/06

[52] U.S. Cl. ..... 66/104

[58] Field of Search ..... 66/104, 106, 109

[56] References Cited

U.S. PATENT DOCUMENTS

| | | | |
|---|---|---|---|
| 1,653,886 | 12/1927 | Billings | 66/106 |
| 3,024,633 | 3/1962 | Kuntz | 66/106 X |
| 3,362,195 | 1/1968 | Goisis | 66/106 |
| 3,735,812 | 5/1973 | Flavell et al. | 66/104 |
| 4,576,018 | 3/1986 | Schindele | 66/106 |
| 4,713,948 | 12/1987 | Schmidt et al. | 66/106 |

FOREIGN PATENT DOCUMENTS

| | | | |
|---|---|---|---|
| 2545212 | 4/1977 | Fed. Rep. of Germany | 66/106 |
| 1137791 | 4/1988 | U.S.S.R. | 66/104 |

*Primary Examiner*—Werner H. Schroeder
*Assistant Examiner*—John J. Calvert
*Attorney, Agent, or Firm*—Larson and Taylor

[57] ABSTRACT

In a flat knitting machine with adjustable sinkers (33), these sinkers are in each case arranged between a needle (43) and a fixed loop-forming web (31) of a needle bed (42) and designed in such a way that they can cooperate with the loop-forming webs (31) forming a draw edge when newly-formed loops are knocked over.

9 Claims, 4 Drawing Sheets

FLAT KNITTING MACHINE

BACKGROUND OF THE INVENTION

1. Field of the Invention

The invention relates to a flat knitting machine having two needle beds, in which sinkers pivotable between the needles and controllable by means of cam parts of the carriage and having an edge influencing the yarn are arranged in such a way that the sinkers of the two needle beds are situated opposite one another and, in a forward pivoting position, form, with projections situated opposite one another, the comb gap of the flat knitting machine.

2. Prior Art

A flat knitting machine of type referred to above is disclosed by German Patent 3,609,539 which is assigned to the same assigned as this application and which corresponding to U.S. Pat. No. 4,713,948 (Schmidt et al.). The bridges in the comb gap, which bridges can be formed by means of the sinkers, prevent loops from being pulled upwards during the outward movement of the needle. The sinkers act as hold-down devices, make the use of push-down devices superfluous and also form there the draw edge for the processed yarn. The cam for controlling the sinkers is here designed in such a way that the sinker adopts a desired position for each of the different functions allocated to it in the course of the formation of a loop. In the case of combination cams of modern knitting machines, in which knitting and loop-transfer systems are combined, a rapid changeover into various functional positions is required of the adjustable sinkers, compromises with the effect that the sinker cannot always adopt or maintain the optimum position for a desired function being inevitable.

SUMMARY OF THE INVENTION

The object on which the invention is based is to avoid the pressures for compromise mentioned above and to create a flat knitting machine which permits optimum and reliable yarn processing even at high operating speeds, in which the adjustable sinkers remain guidable into the best operating positions for achieving optimum effects without other operating functions thereby being impaired. According to the invention the object set is achieved with a flat knitting machine of the type stated at the outset by the fact that, as seen in the longitudinal direction of the needle beds, the adjustable sinkers are in each case arranged between a needle allocated to them and an immovable loop-forming web known per se and having a draw edge extending at an angle to the fabric take-down direction, and that the edge of the sinkers which influences the yarn extends below its bridge-forming projection away from the comb gap to behind a loop knock-over edge of the needle bed and, in each section and in each adjustment position of the sinkers, extends at an angle to the fabric take-down direction which deviates from the corresponding angle of the fixed draw edge of the loop-forming web.

With a design and arrangement of the loop-forming tools of the flat knitting machine according to the invention, the advantage is obtained that the configuration and movement of the sinkers in the region of their edges influencing the yarn can be better adapted to the yarn-guiding and loop hold-down function. By means of the fixed loop-forming webs, a draw edge is created which remains fixed at an optimum course irrespective of the adjustment movements of the sinkers. The sinker at least predominantly relieved of the drawing function can be used to a greater extent for holding down loops and for promoting yarn insertion into the needles, this being highly advantageous particularly when working with latchless needles. During the transfer of loops, the sinker can be controlled more independently and more precisely for opening and closing the comb gap than was the case hitherto. Thus, an optimum influencing of the yarn and of the loops formed is achieved in the interplay of the yarn-influencing edges of the movable sinkers with the unmoved draw edge of the loop-forming webs during the needle movement. Disturbance of the draw motion by the moved sinkers can be completely excluded.

The edge of the sinkers which influences the yarn can advantageously be divided into at least two sections of different angular position relative to the fabric take-down direction, of which at least the forward section beginning at the bridge-forming projection of the sinker can be moved beyond the draw edge of the loop-forming web, into the comb gap, during an adjustment movement of the sinker. With the bridge-forming sinker projection adjusted back behind the draw edge of the loop-forming web, the forward section of the edge of the sinkers which influences the yarn can expediently extend at least approximately at the same distance as the yarn-receiving throat of the needle head from the bed of the needle guide channel of the needle bed and hence ensure reliable yarn insertion into the needle head even at high operating speeds.

In a flat knitting machine designed in accordance with the invention, the movable sinkers can also assist loop draw-off in that, during their adjustment movement into the comb gap, they can simultaneously also be moved downward. As regards their influence on the loops formed, the sinkers are thus no longer limited to the function of holding down the loops in the comb gap.

After their draw edge in the fabric take-down direction, advantageously the loop-forming webs can have an undercut edge extending toward the loop knock-over edge of the needle bed, and the second section of the edge of the sinkers which influences the yarn can extend, in the bridge-forming position of the sinkers, at least approximately parallel to the undercut edge of the loop-forming webs. It can thereby be achieved on the one hand that the edge of the adjustable sinkers which influences the yarn does not project beyond the undercut edge of the loop-forming webs and does not interfere with loops coming to rest there, and, on the other hand, that the displacement movement of these loops along the undercut edge toward the loop knock-over edge of the needle bed is assisted. Between their draw edge and their undercut edge, the loop-forming webs can have a projection directed into the comb gap, said projection promoting, inter alia in the case of multiyarn knitting, the ordered laying of yarn against the draw edge.

BRIEF DESCRIPTION OF THE DRAWINGS

An illustrative embodiment of a flat knitting machine designed in accordance with the invention is explained in greater detail below with reference to the attached drawing, in which.

DESCRIPTION OF THE PREFERRED EMBODIMENTS

Figure 1:
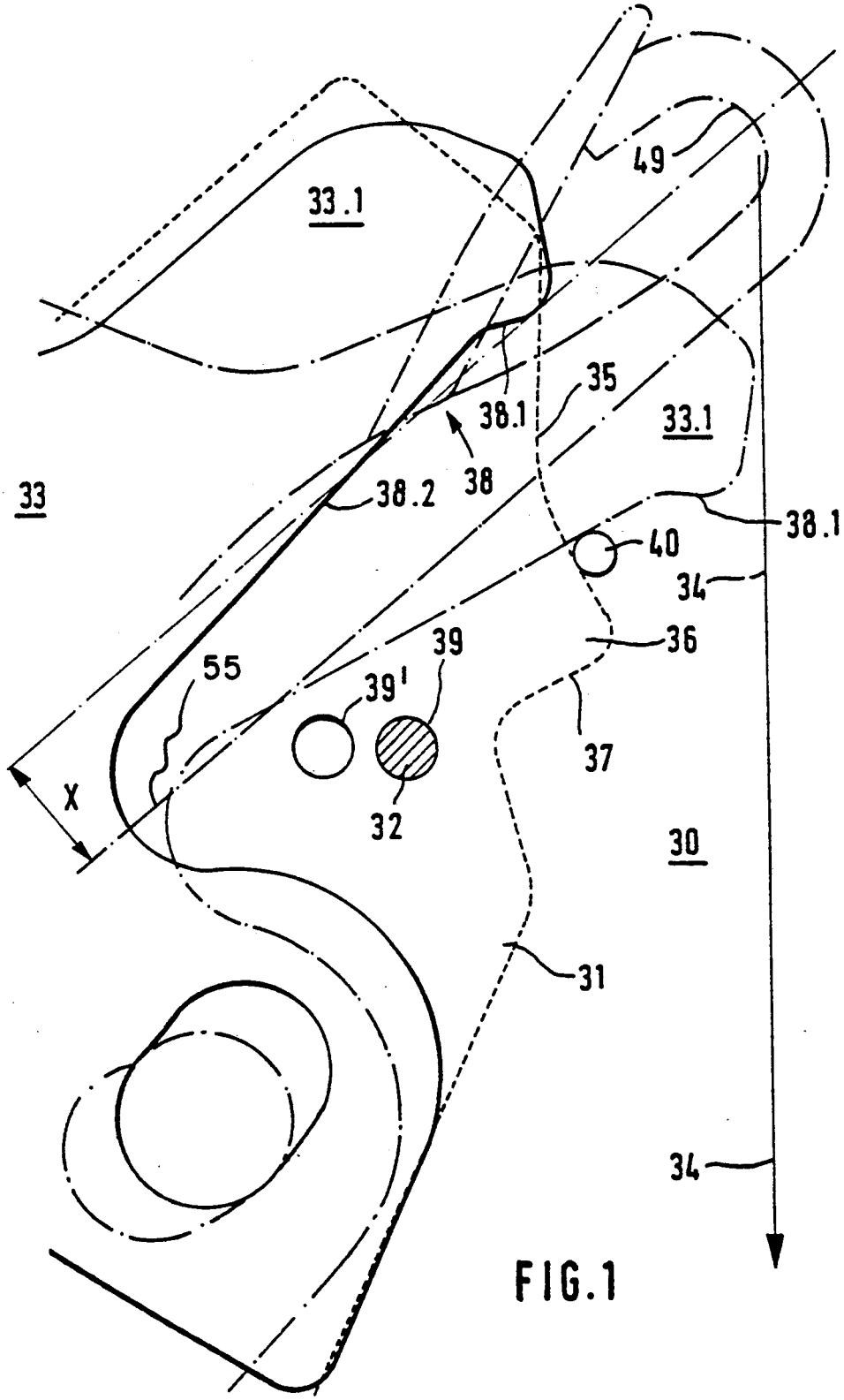
FIG. 1 shows the region of a loop-forming web which delimits the comb gap of a flat knitting machine, and a part of a sinker cooperating with this loop-forming web.

In FIG. 1, a dotted line is used to illustrate the edge region of a stationary loop-forming web 31, said edge region contributing to the delimitation of the comb gap 30 between the two needle beds of a flat knitting machine. FIG. 1 furthermore shows, in section, a wire 32 passed through openings 39, 39' in the loop-forming webs 31 over the entire length of a needle bed parallel to the comb gap 30, said wire forming the loop knock-over edge of the needle bed. A plurality of openings 39, 39' at different distances from the draw edge 35 can be provided. A projection 33.1 of an adjustable sinker 33 cooperating with the loop-forming web 31 is illustrated with a solid line in a first position and with a chain line in a position in which it has moved forward as far as the centre of the comb gap 30, indicated by a line 34. The line 34 simultaneously denotes the fabric take-down direction of the machine. Formed on the stationary loop-forming web 31 in a region above the wire 32 forming the loop knock-over edge is a draw edge 35, which extends at an acute angle to the fabric take-down direction 34. Adjoining this draw edge 35 toward the bottom are a projection 36 directed into the comb gap 30 and then an undercut edge 37 extending toward the wire 32. An edge 38 divided into two sections 38.1 and 38.2 is formed on the underside of the projection 33.1, of the adjustably mounted sinker 33 and is movable forward into the comb gap 30, with the sinker 33. With this edge 38 a yarn 40 resting against the draw edge 35 of the loop-forming web 31 can be caught as the projection 33.1 moves forward and moved downward in the direction of the fabric take-down direction 34. The edge 38 of the sinker 33 extends away from the comb gap 30 to behind the wire 32, forming the loop knock-over edge, of the needle bed and, with each section and in each adjustment position of the sinker 33, forms an angle to the fabric knock-over direction 34 which is different from the angle which the draw edge 35 of the stationary loop-forming web 31 forms with the fabric take-down direction 34. In the position of the sinker 33 illustrated by the chain line, in which the sinker 33 bridges the comb gap, the rear edge section 38.2 extends approximately parallel to the undercut edge 37 of the loop-forming web 31.

In FIG. 1, a needle, including a needle back 55 resting on the bed of a needle guide channel, and a needle head 49, is indicated by a chain line. In the position of the sinker 33 represented by a solid line, the forward section 38.1 of its edge 38 extends at a distance X from the needle back and at the level of the centre of the needle head 49, thereby allowing a presented yarn to be guided to the level of the needle head 49 by a sinker projection 33.1 moved forward slightly into the comb gap 30.

The relative position of the adjustable sinkers 33 to the needles, adjustable in known manner in the longitudinal direction and indicated only by a chain line in FIG. 1, and to the stationary loop-forming webs 31 during loop formation can be seen from FIGS. 2a–2e. The latter all show the two needle beds 41 and 42 of a flat knitting machine with their loop-forming webs 31 delimiting the comb gap 30. The pivotable sinkers 33 each cooperating with one of these loop-forming webs 31 and situated opposite one another in pairs are shown completely.

Figure 2A:
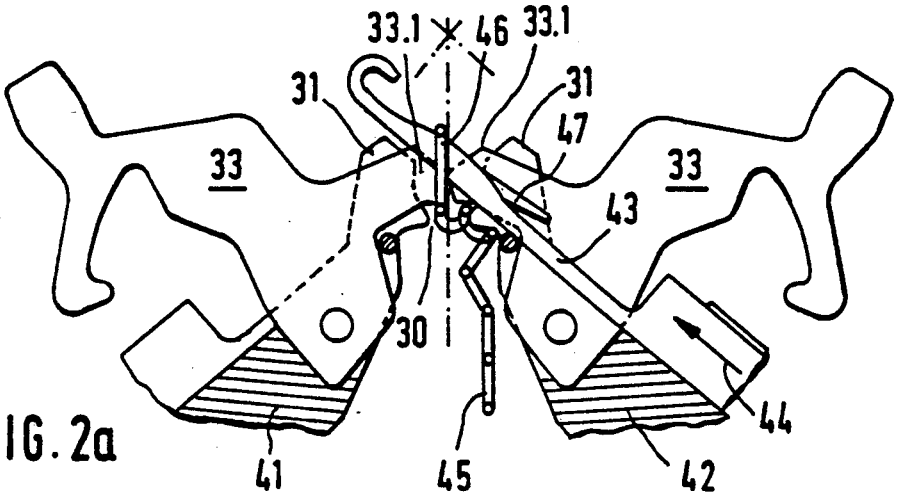
FIGS. 2a–2e show a cross-section through the loop-forming region of the needle bed of a flat knitting machine with sinkers and with the needle of one of the two needle beds in five different positions during the knitting process.

FIG. 2a shows a latch needle 43 during its outward movement in the direction of the arrow 44 drawn in. During this outward movement, the fabric 45 hanging into the comb gap is prevented from being pulled upward by the outward-moving latch needle 43 by the projections 33.1, moving into the comb gap 30, of the sinkers 33, which form bridges closing the comb gap 30. The last-formed "old" loop 46 slides rearwards over the stem of the needle 43 in known manner, opening the needle latch 47.

Figure 2B:
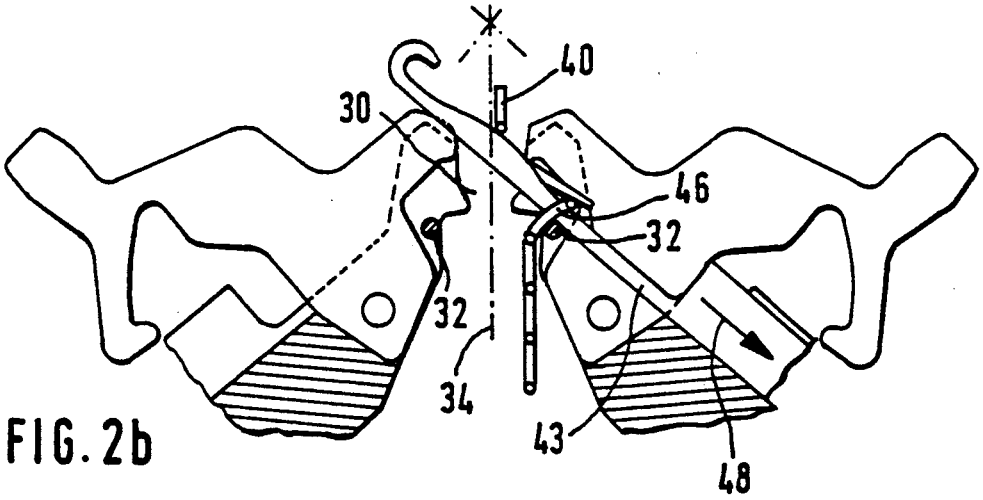
Figure 2C:
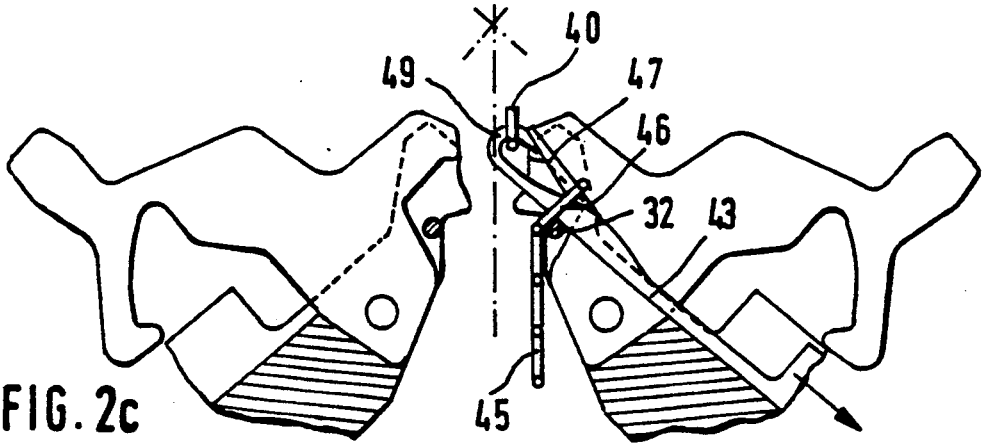

When subsequently the draw-down movement of the needle according to FIG. 2b in the direction of the arrow 48 drawn in there begins, the old loop 46 is held against the loop knock-over edge, which is formed by the wire 32 described in connection with FIG. 1. A new yarn 40 is presented by a yarn carrier (not shown), which yarn is caught by the needle head 49 during the further draw-down movement of the needle 43, as can be seen from FIG. 2c. The reliable catching of the yarn 40 is promoted by the projection 33.1 of the sinkers 33, which holds down the yarn to the level of the needle head 49. Before the beginning of the needle draw-down movement, the sinkers 33 have been pivoted back, freeing the comb gap 30, as can be seen from FIG. 2b and FIG. 2c. FIG. 2c also shows how the old loop 46 resting against the loop knock-over edge 32 has closed the latch needle 47.

Figure 2D:
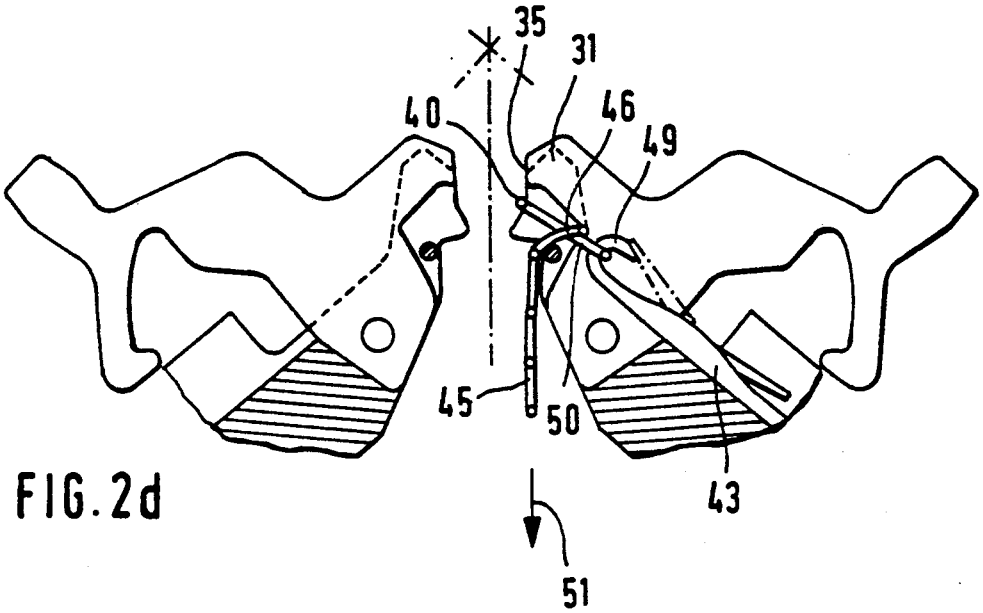
Figure 2E:
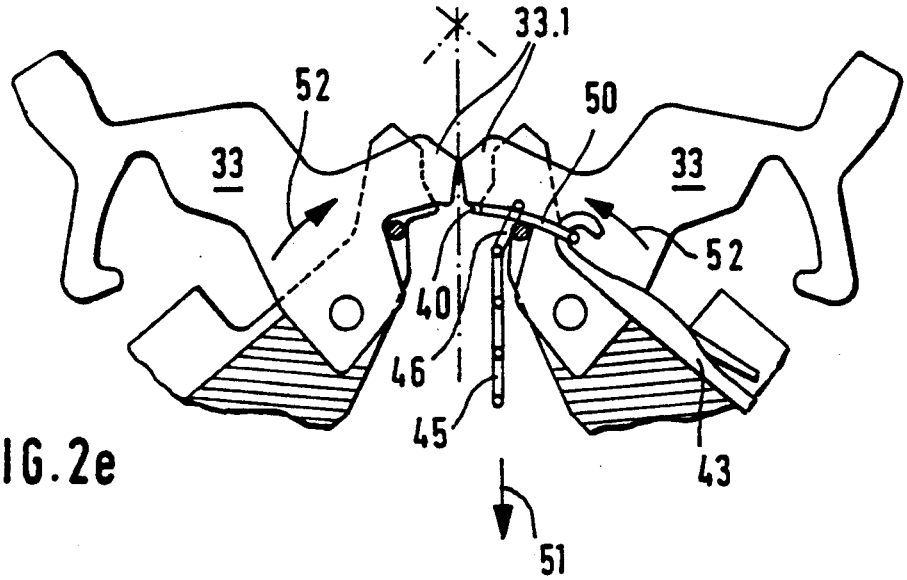

FIG. 2d shows the latch needle 43 in its maximum drawn-down position, in which the needle head 49 has passed through the old loop 46 and has drawn a new loop 50 from the yarn 40 which has come to rest against the draw edge 35 of the loop-forming web 31. FIG. 2d shows that this new loop 50 has been drawn into the old loop 46 over only part of its length. Complete drawing in is then effected by the draw-off device (not shown), which exerts a tensile force on the fabric 45 in the direction of the arrow 51 drawn in in FIG. 2d. The casting off of the yarn 40 from the draw edge 35 of the loop-forming webs 31 is promoted by the adjustable sinkers 33, which, according to FIG. 2e are subsequently pivoted back in the direction of the arrows 52 drawn in in FIG. 2e, with the result that their projections 33.1 catch the yarn 40 with their edge 38 (FIG. 1) and move it downward into the comb gap before the latch needles 43 begin their outward movement again.

During the formation of a loop in the flat knitting machine shown, the yarn is thus first of all influenced only by the latch needle and the stationary loop-forming webs and only at the end, over a short distance, by the old loop as well due to the effect of friction. The adjustable sinkers, the draw-off mechanism and also the loop knock-over edge then come into effect on the newly-formed loop, with low and, above all, uniformly distributed frictional forces on the loop then being able to come into effect. These frictional forces can be further reduced by providing the wire 32 of the needle beds, said wire forming the loop knock-over edge, with a rotary drive.

Figure 3:
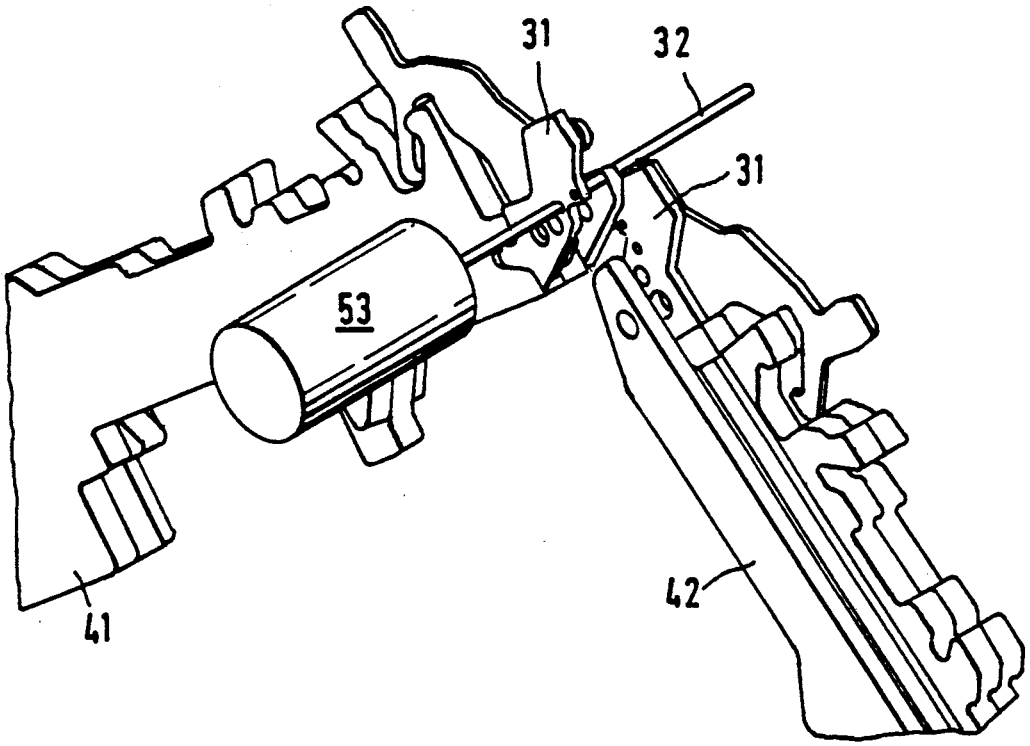
FIG. 3 shows a perspective representation of one end of the needle beds.

FIG. 3 shows an electric motor 53 which is arranged at the end of one of the two needle beds 41 and the drive shaft of which is connected in a manner not shown in detail to the end of the continuous wire 32 extending over the entire length of a needle bed. The electric motor 53 can be a controllable and reversible stepping motor. Instead of a forcibly rotatable wire 32, the loop knock-over edge of a needle bed can also comprise wire or tube sections which are in each case mounted in freely rotatable fashion between adjacent stationary loop-forming webs 31 and can rotate concomitantly during a movement of a loop over the loop knock-over edge.

We claim:

1. A flat knitting machine having an associated fabric take-down direction, and including a comb gap defined therein, said machine comprising:

first and second needle beds each including a set of needles and a loop knock-over edge;

adjustable sinkers pivotable between the needles of the first and second needle beds and disposed oppositely one another, said sinkers each including a projection thereon and an edge for influencing movement of yarn supplied to the machine, said edge extending below said projection away from the comb gap to a position behind the loop-knock-over edge of the associated needle bed;

stationary loop-forming webs disposed oppositely one another so as to at least partially define said comb gap, said webs each including a draw edge extending at an angle to the fabric take-down direction of the machine; and means for providing pivoting said sinkers between (i) a forward position wherein the projections on said sinkers bridge the comb gap and block the comb gas at the top thereof and wherein each section of said edge of the sinkers extends at an angle to the fabric taken-down direction which is different from said angle of said draw edge of the associated loop-forming web, and (ii) a rearward position wherein each section of said edge of the sinkers extends at an angle to the take-down direction which is also different from said angle of said draw edge of the associated loop-forming web.

2. A flat knitting machine as claimed in claim 1, wherein said edge of the sinkers divided into at least two sections of different angular positions relative to the fabric take-down direction and including a forward section beginning at the projection of the associated sinker; and wherein at least said forward section beginning at the bridge-forming projection (31.) of the sinker can be moved beyond the draw edge of the loop-forming web, into the comb gap during said pivoting of the sinker to said forward position and wherein during said pivoting of the sinker to said forward position the forward section of said edge of the sinker is moved downwardly and into the comb gap.

3. A flat knitting machine as claimed in claim 1 wherein the needle beds include a needle guide channel having a bed, wherein said needles include a needle head having a center and a needle back, wherein said edge of said sinkers includes a forward section and wherein when said sinkers are in the rearward position thereof said forward section extends at least approximately the same distance as the center of the needle head of the corresponding needle from the bed of the needle guide channel of the associated needle bed or from the needle back of said corresponding needle.

4. A flat knitting machine as claimed in claim 1 wherein the loop-forming webs include, disposed after the draw edge thereof, in the fabric take-down direction, an undercut edge extending toward the loop knock-over edge of the associated needle bed and wherein a section of said edge of the sinkers extends, in the forward position of the sinkers, at least approximately parallel to the undercut edge of the loop-forming webs.

5. A flat knitting machine as claimed in claim 1, wherein said loop forming webs include, between the draw edge thereof and an undercut edge, a projection directed towards the comb gap.

6. A flat knitting machine as claimed in claim 1, wherein the distance between the loop knock-over edge of the needle beds and the draw edge of the corresponding loop-forming webs is adjustable.

7. A flat knitting machine as claimed in claim 1, wherein the loop knock-over edge between the loop-forming webs is formed by a rod or sleeve mounted so as to be freely rotatable about the longitudinal axis of the rod or sleeve.

8. A flat knitting machine as claimed in claim 1, wherein the loop knock-over edge comprises a wire extending over the entire length of a needle bead and passing through an opening in the loop-forming webs, and wherein the loop-forming webs include a plurality of wire passage openings which are spaced different distances from the draw edge of the associated loop-forming webs.

9. A flat knitting machine as claimed in claim 8, wherein the wire forming the loop knock-over edge is coupled to a rotary drive mechanism.

* * * * *